US009134692B2

(12) United States Patent
Sato

(10) Patent No.: US 9,134,692 B2
(45) Date of Patent: Sep. 15, 2015

(54) IMAGE FORMING APPARATUS THAT ACCOMMODATES CARTRIDGE WITH SUFFICIENT AMOUNT OF DEVELOPER

(71) Applicant: Shougo Sato, Seto (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 133 days.

(21) Appl. No.: 14/067,305

(22) Filed: Oct. 30, 2013

(65) Prior Publication Data

US 2014/0119773 A1 May 1, 2014

(30) Foreign Application Priority Data

Oct. 31, 2012 (JP) ..... 2012-239998
Jul. 22, 2013 (JP) ..... 2013-151853

(51) Int. Cl.
*G03G 15/00* (2006.01)
*G03G 15/08* (2006.01)
*G03G 21/16* (2006.01)

(52) U.S. Cl.
CPC ..... *G03G 21/1676* (2013.01); *G03G 15/0896* (2013.01); *G03G 2221/1684* (2013.01); *G03G 2221/1869* (2013.01)

(58) Field of Classification Search
CPC ..... G03G 15/0896; G03G 21/1676; G03G 2221/1869; G03G 2221/1684
USPC ..... 399/110, 119, 262, 263
See application file for complete search history.

(56) References Cited

U.S. PATENT DOCUMENTS

| | | | | |
|---|---|---|---|---|
| 7,110,707 | B2 * | 9/2006 | Nishitani | |
| 7,257,349 | B2 | 8/2007 | Kitozaki | |
| 7,272,346 | B2 * | 9/2007 | Ito | 399/263 |
| 8,050,589 | B2 | 11/2011 | Okabe | |
| 8,185,022 | B2 | 5/2012 | Sato | |
| 8,358,952 | B2 | 1/2013 | Okabe | |
| 8,565,650 | B2 | 10/2013 | Sato | |
| 8,879,965 | B2 * | 11/2014 | Kato | 399/263 |
| 8,913,921 | B2 * | 12/2014 | Sato | |
| 2005/0281581 | A1 | 12/2005 | Kitozaki | |
| 2005/0281591 | A1 | 12/2005 | Kitozaki et al. | |
| 2008/0025758 | A1 | 1/2008 | Sato | |
| 2009/0123177 | A1 * | 5/2009 | Dawson et al. | 399/119 |

(Continued)

FOREIGN PATENT DOCUMENTS

| | | | |
|---|---|---|---|
| JP | 2006-030958 | A | 2/2006 |
| JP | 2008-026828 | A | 2/2008 |

(Continued)

*Primary Examiner* — Susan Lee
(74) *Attorney, Agent, or Firm* — Banner & Witcoff, Ltd.

(57) ABSTRACT

An image forming apparatus includes a main casing, a supporting frame movable relative to the main casing in a first direction between an internal position and an external position, and a developer container supported in the supporting frame. The main casing includes first and second walls extending in the first direction and opposing each other in a second direction orthogonal to the first direction. The supporting frame includes first and second plates opposing the first and second walls in the second direction respectively. The developer container includes: a first chamber disposed between the first plate and the second plate; a second chamber for storing developer and disposed between the first wall and the first plate; a third chamber for communicating between the first chamber and the second chamber; and a conveying portion for conveying the developer in the second chamber to the first chamber via the third chamber.

13 Claims, 10 Drawing Sheets

(56) References Cited

U.S. PATENT DOCUMENTS

| | | | | |
|---|---|---|---|---|
| 2009/0208245 | A1 | 8/2009 | Sato | |
| 2009/0324275 | A1 | 12/2009 | Okabe | |
| 2012/0057900 | A1 | 3/2012 | Okabe | |
| 2012/0213556 | A1 | 8/2012 | Sato | |
| 2012/0263496 | A1* | 10/2012 | Morita | 399/119 |
| 2013/0028632 | A1* | 1/2013 | Sato et al. | 399/110 |
| 2013/0101317 | A1* | 4/2013 | Shimizu et al. | |
| 2014/0029978 | A1* | 1/2014 | Mogi | 399/110 |

FOREIGN PATENT DOCUMENTS

| | | | |
|---|---|---|---|
| JP | 2009-180956 | A | 8/2009 |
| JP | 2009-193007 | A | 8/2009 |
| JP | 2010-008724 | A | 1/2010 |

* cited by examiner

IMAGE FORMING APPARATUS THAT ACCOMMODATES CARTRIDGE WITH SUFFICIENT AMOUNT OF DEVELOPER

CROSS REFERENCE TO RELATED APPLICATION

This application claims priority from Japanese Patent Application Nos. 2012-239998 filed Oct. 31, 2012 and 2013-151853 filed Jul. 22, 2013. The entire contents of the priority applications are incorporated herein by reference.

TECHNICAL FIELD

The present invention relates to an electrophotographic image forming apparatus.

BACKGROUND

One image-forming device known in the art is a horizontal tandem-type color printer provided with a plurality of photosensitive drums that are arranged parallel to each other and juxtaposed horizontally (hereinafter called the "juxtaposing direction"), and a plurality of developing cartridges for respectively supplying developer to the photosensitive drums.

Of these types of color printers, a proposal has been provided for a printer having a support frame that integrally supports a plurality of photosensitive drums and a plurality of developing cartridges. The support frame can be moved with respect to the juxtaposed direction between an accommodated position and a withdrawn position. The printer also includes an intermediate transfer belt that contacts the photosensitive drums when the support frame is disposed in the accommodated position. Each developing cartridge includes a developing roller that contacts a corresponding photosensitive drum, and a toner-accommodating chamber for accommodating toner to be supplied onto the developing roller. The developing cartridges are detachably supported in the support frame and can be mounted therein and removed therefrom with respect to an axial direction of the developing rollers while the support frame is disposed in the withdrawn position.

SUMMARY

In the conventional printer described above, the photosensitive drums are arranged in their juxtaposed direction so as to confront both the intermediate transfer belt and the corresponding developing rollers while the support frame is disposed in the accommodated position. Further, the toner-accommodating chambers of the developing cartridges that accommodated toner to be supplied onto the corresponding developing rollers are also aligned in the juxtaposed direction. Consequently, this arrangement increases the dimension of the printer in the juxtaposed direction, which leads to a desire to reduce this dimension of the printer. However, if the dimension of the conventional printer with respect to the juxtaposed direction is made more compact, sizes of the toner-accommodating chambers must be reduced. Consequently, the toner-accommodating chambers cannot be made large enough to accommodate a sufficient amount of toner.

In view of the foregoing, it is an object of the present invention to provide an image forming apparatus that can be made more compact while allocating sufficient space to accommodate an adequate amount of developer.

In order to attain the above and other objects, there is provided an image forming apparatus including: a main casing, a supporting frame and a developer container. The main casing includes a first wall and a second wall extending in a first direction and opposing each other in a second direction orthogonal to the first direction. The supporting frame is configured to move relative to the main casing in the first direction between an internal position accommodated in the main casing and an external position withdrawn from the main casing, the supporting frame comprising a first plate and a second plate extending in the first direction and configured to oppose the first wall and the second wall in the second direction respectively when the supporting frame is at the internal position. The developer container is configured to be supported in the supporting frame and configured to store developer therein, the developer container including: a first chamber configured to be disposed between the first plate and the second plate; a second chamber configured to store developer therein and be disposed between the first wall and the first plate when the supporting frame is at the internal position; a third chamber configured to establish communication between the first chamber and the second chamber; and a conveying portion configured to convey the developer stored in the second chamber to the first chamber via the third chamber.

DETAILED DESCRIPTION

1. Overall Structure of Printer

Figure 1:
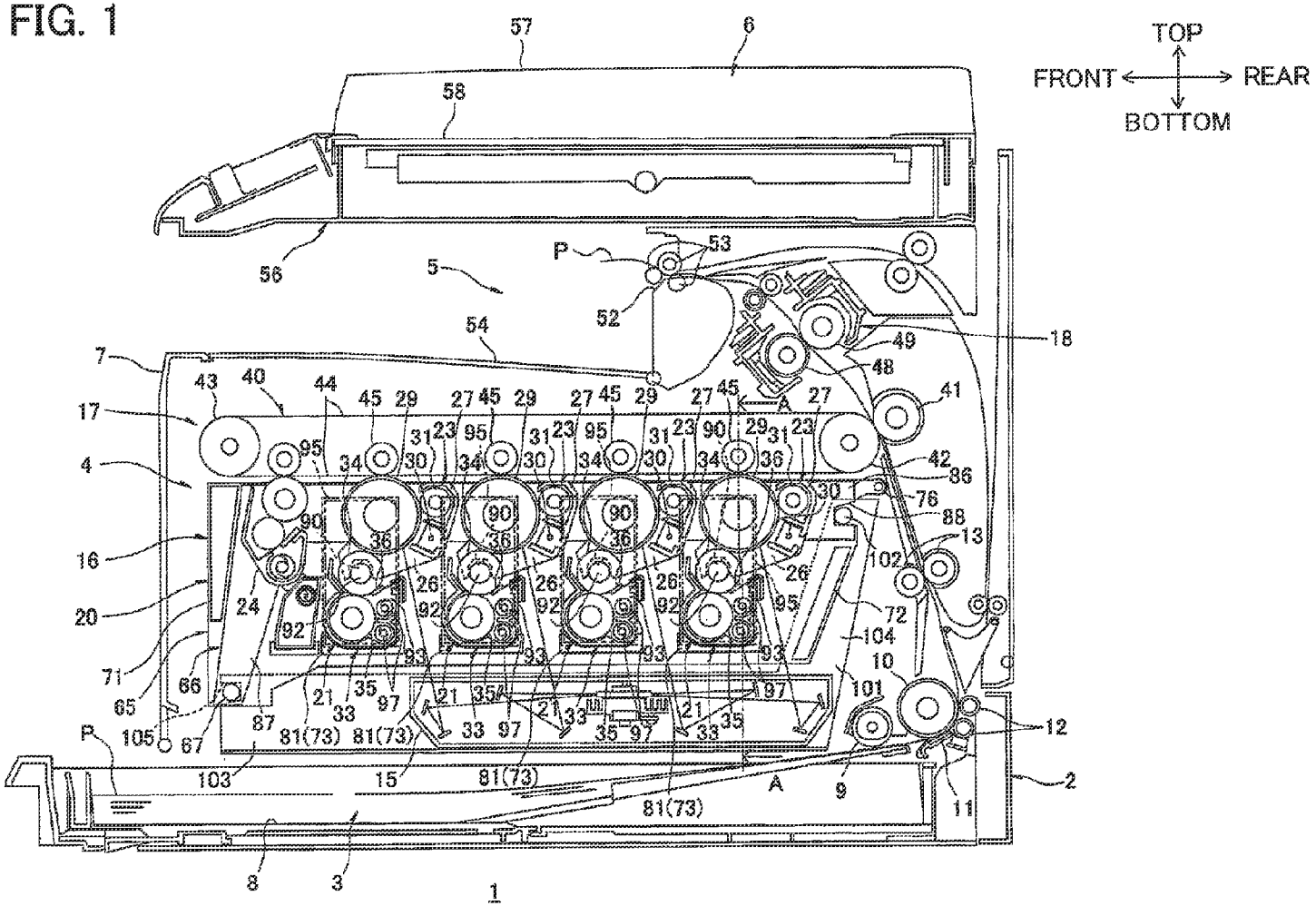
FIG. 1 is a central cross-sectional view of a printer as an example of an image forming apparatus according to a first embodiment of the present invention, wherein the printer includes a process unit therein and the process unit is in an accommodated position.

A printer 1 is a direct horizontal tandem-type color printer, as shown in FIG. 1. The printer 1 is an example of an image forming apparatus according to a first embodiment of the present invention.

In the following description, directions related to the printer 1 will be given based on the state of the printer 1 when the printer 1 is resting on a level surface. Hence, the side of the printer 1 at the top of FIG. 1 will be considered the upper side, and the side at the bottom will be considered the lower side. Further, the left side of the printer 1 in FIG. 1 will be considered the front side, and the right side will be considered the rear side. Left and right sides of the printer 1 will be based on the perspective of a user facing the front of the printer 1. Hence, the near side of the printer 1 in FIG. 1 will be considered the right side, and the far side will be considered the left side.

The printer 1 is provided with a main casing 2 within which provided are a sheet-feeding unit 3 for feeding sheets of paper P to be printed, an image-forming unit 4 for forming images on the sheets P fed by the sheet-feeding unit 3, and a discharge unit 5 for receiving the sheets P discharged on which images have been formed. An image-reading unit 6 is provided above the main casing 2 for reading image data of originals.

(1) Main Casing

The main casing 2 has a box-like shape. The main casing 2 is provided with a front cover 7.

The front cover 7 is provided on the front side of the main casing 2 and is capable of pivoting about a lower end portion of a front wall of the main casing 2. When the front cover 7 is pivoted downward away from the main casing 2, a process unit 16 described later can be slid into and out of the main casing 2.

(2) Sheet-Feeding Unit

The sheet-feeding unit 3 includes a paper tray 8, a pickup roller 9, a feeding roller 10, a feeding pad 11, a pair of pinch rollers 12, and a pair of registration rollers 13.

The paper tray 8 is disposed in a bottom section of the main casing 2. The paper tray 8 is detachably mounted in the main casing 2. The paper tray 8 functions to accommodate sheets of paper P.

The pickup roller 9 is disposed above a rear end of the paper tray 8.

The feeding roller 10 is disposed rearward of the pickup roller 9.

The feeding pad 11 is disposed beneath the feeding roller 10 so as to contact the bottom peripheral surface thereof.

The pinch rollers 12 are juxtaposed vertically and positioned to contact the rear peripheral surface of the feeding roller 10.

The registration rollers 13 are disposed above the feeding roller 10 and confront each other in a front-rear direction.

The pickup roller 9 rotates to pick up sheets of paper P in the paper tray 8 and convey the sheets P between the feeding roller 10 and feeding pad 11, whereby the rotation of the feeding roller 10 separates and feeds the sheets P one sheet at a time. The rotating feeding roller 10 subsequently conveys each sheet of paper P upward toward the registration rollers 13 so that the sheets P pass sequentially between each pinch roller 12 and the feeding roller 10. The registration rollers 13 rotate in order to convey the sheets P at a prescribed timing between an intermediate transfer belt 44 and a secondary transfer roller 41, both described later.

(3) Image Forming Unit

The image-forming unit 4 includes a scanning unit 15, a process unit 16, a transfer unit 17, and a fixing unit 18.

(3-1) Scanning Unit

The scanning unit 15 is disposed in a lower section of the main casing 2 above the paper tray 8. The scanning unit 15 emits four laser beams toward respective photosensitive drums 29 (described later), the paths of which are depicted by solid lines in FIG. 1, thereby exposing the photosensitive drums 29.

(3-2) Process Unit

The process unit 16 is disposed above the scanning unit 15 in an approximate vertical center of the main casing 2. The process unit 16 includes a process frame 20, and four developing cartridges 21.

The process frame 20 has a frame-like structure that is generally rectangular in a plan view. The process frame 20 includes four drum frames 23.

The drum frames 23 are provided inside the process frame 20 and are arranged at intervals in the front-rear direction. Each drum frame 23 is provided with a pair of side walls 26, and a rear wall 27.

The side walls 26 are arranged parallel to each other and are spaced apart in a left-right direction. The side walls 26 have a flat plate shape that is generally rectangular in a side view.

The rear wall 27 integrally bridges rear ends of the side walls 26. The rear wall 27 has a general flat plate shape that is elongated in the left-right direction.

Each drum frame 23 is further provided with a photosensitive drum 29, and a scorotron charger 30.

The photosensitive drum 29 has a general cylindrical shape with its axis oriented in the left-right direction. The photosensitive drum 29 is rotatably supported to the side walls 26.

The scorotron charger 30 is embedded in a lower portion of the rear wall 27 at a position obliquely downward and rearward of the photosensitive drum 29. The scorotron charger 30 is spaced away from the photosensitive drum 29.

Each drum frame 23 is also provided with a drum cleaner 31.

The drum cleaner 31 is disposed on a top end portion of the rear wall 27 and is positioned to contact a rear peripheral surface of the photosensitive drum 29. The drum cleaner 31 functions to clean the peripheral surface of the photosensitive drum 29.

The process frame 20 is also provided with a belt cleaner 24.

The belt cleaner 24 is disposed in a front end portion of the process frame 20 at a position for contacting a lower portion of an intermediate transfer belt 44 of a belt unit 40 described later. The belt cleaner 24 functions to clean the intermediate transfer belt 44.

The four developing cartridges 21 are disposed at positions beneath the corresponding photosensitive drums 29. Each developing cartridge 21 includes a developing frame 33, and a developing roller 34.

The developing frame 33 has a box-like shape that is open on the top, and is elongated in the left-right direction. The developing frame 33 serves to accommodate toner.

The developing roller 34 is disposed in an upper end portion of the developing frame 33. A peripheral surface of the developing roller 34 is partially exposed from the developing frame 33 on its top side. The developing roller 34 is rotatably supported to the developing frame 33 by a developing-roller shaft 92 that penetrates side walls of the developing frame 33 and protrudes outward therefrom. The developing roller 34 contacts the lower peripheral surface of the photosensitive drum 29.

The developing cartridge 21 is further provided with a supply roller 35 for supplying toner to the developing roller 34, and a thickness-regulating blade 36 for regulating the thickness of the toner layer carried on the developing roller 34.

(3-3) Transfer Unit

The transfer unit 17 is disposed in an upper section of the main casing 2 above the process unit 16. The transfer unit 17 includes the belt unit 40, and a secondary transfer roller 41.

The belt unit 40 is elongated in the front-rear direction so as to be positioned above all the photosensitive drums 29. The belt unit 40 includes a drive roller 42, a follow roller 43, the intermediate transfer belt 44, and four primary transfer rollers 45.

The drive roller 42 is rotatably supported at a rear end of the transfer unit 17.

The follow roller 43 is rotatably supported at a front end of the transfer unit 17.

The intermediate transfer belt 44 is mounted on and looped around the drive roller 42 and follow roller 43 so that the lower portion of the loop contacts the top peripheral surfaces of all photosensitive drums 29. When the drive roller 42 is driven to rotate, the intermediate transfer belt 44 circulates so that its lower portion moves rearward, and the follow roller 43 rotates along with the circulating movement of the intermediate transfer belt 44.

The primary transfer rollers 45 are arranged parallel to each other and spaced at intervals in the front-rear direction. More specifically, the primary transfer rollers 45 are disposed between the drive roller 42 and follow roller 43 within the loop of the intermediate transfer belt 44 at positions above the corresponding photosensitive drums 29. The primary transfer rollers 45 contact the lower portion of the intermediate transfer belt 44 from above.

The secondary transfer roller 41 is disposed on the rear side of the drive roller 42, with the intermediate transfer belt 44 nipped therebetween.

(3-4) Fixing Unit

The fixing unit 18 is disposed obliquely above and forward of the secondary transfer roller 41. The fixing unit 18 includes a heating roller 48, and a pressure roller 49 that contacts a rear peripheral surface of the heating roller 48 with pressure.

(3-5) Image-Forming Operation (3-5-1) Developing Operation

In an image-forming operation, the supply roller 35 rotates to supply toner from the developing cartridge 21 onto the developing roller 34. The toner is tribocharged between the supply roller 35 and developing roller 34. The thickness-regulating blade 36 regulates the thickness of toner supplied to the developing roller 34 as the developing roller 34 rotates, maintaining the layer of toner on the peripheral surface of the developing roller 34 at a thin uniform thickness.

In the meantime, the scorotron charger 30 applies a uniform charge to the peripheral surface of the photosensitive drum 29 as the photosensitive drum 29 rotates. Subsequently, the scanning unit 15 exposes the surface of the photosensitive drum 29 based on prescribed image data, forming an electrostatic latent image on the surface of the photosensitive drum 29 based on the image data. Next, the toner carried on the surface of the developing roller 34 is supplied to the latent image formed on the surface of the photosensitive drum 29, thereby developing the latent image into a toner image.

(3-5-2) Transferring and Fixing Operations

A primary transfer is performed by sequentially transferring toner images carried on the surfaces of the photosensitive drums 29 onto the lower portion of the intermediate transfer belt 44. Through this primary transfer, the photosensitive drums 29 form a color image on the surface of the intermediate transfer belt 44. As the intermediate transfer belt 44 passes through a contact position with the secondary transfer roller 41, the color image formed on the surface of the intermediate transfer belt 44 is transferred in a secondary transfer onto a sheet of paper P supplied from the sheet-feeding unit 3. Next, the color image transferred onto the sheet P is fixed to the sheet P by heat and pressure as the sheet P passes between the heating roller 48 and pressure roller 49 in the fixing unit 18.

(4) Discharge Unit

The discharge unit 5 protrudes upward from the top of the main casing 2 on a rear side thereof. The discharge unit 5 includes a discharge opening 52, and three discharge rollers 53.

The discharge opening 52 is formed in a front surface of the discharge unit 5 and provides communication between interior and exterior of the main casing 2.

The discharge rollers 53 are positioned to guide the sheets of paper P being discharged through the discharge opening 52.

The top surface of the main casing 2 forward of the discharge unit 5 functions as a discharge tray 54. After a toner image has been fixed to a sheet of paper P in the fixing unit 18, the discharge rollers 53 discharge the sheet P through the discharge opening 52 onto the discharge tray 54.

(5) Image-Reading Unit

The image-reading unit 6 is disposed above the main casing 2 so as to cover the discharge unit 5. The image-reading unit 6 has a general rectangular shape in a plan view, with approximately the same front-rear and left-right dimensions as the main casing 2. The image-reading unit 6 includes a flatbed 56, and an original cover 57.

The flatbed 56 has a box-like shape and a general rectangular shape in a plan view. The flatbed 56 includes a glass surface 58.

The glass surface 58 constitutes the top surface of the flatbed 56 and serves to support an original.

The original cover 57 has a thick plate shape that is generally rectangular in a plan view. The original cover 57 is pivotably supported on the flatbed 56 and covers the top of the flatbed 56.

The image-reading unit 6 reads image data from an original placed between the glass surface 58 of the flatbed 56 and the original cover 57. As described above, the image-forming unit 4 can form images on sheets of paper P based on image data read from an original.

2. Detailed Description of the Process Unit (1) Process Frame

Figure 4:
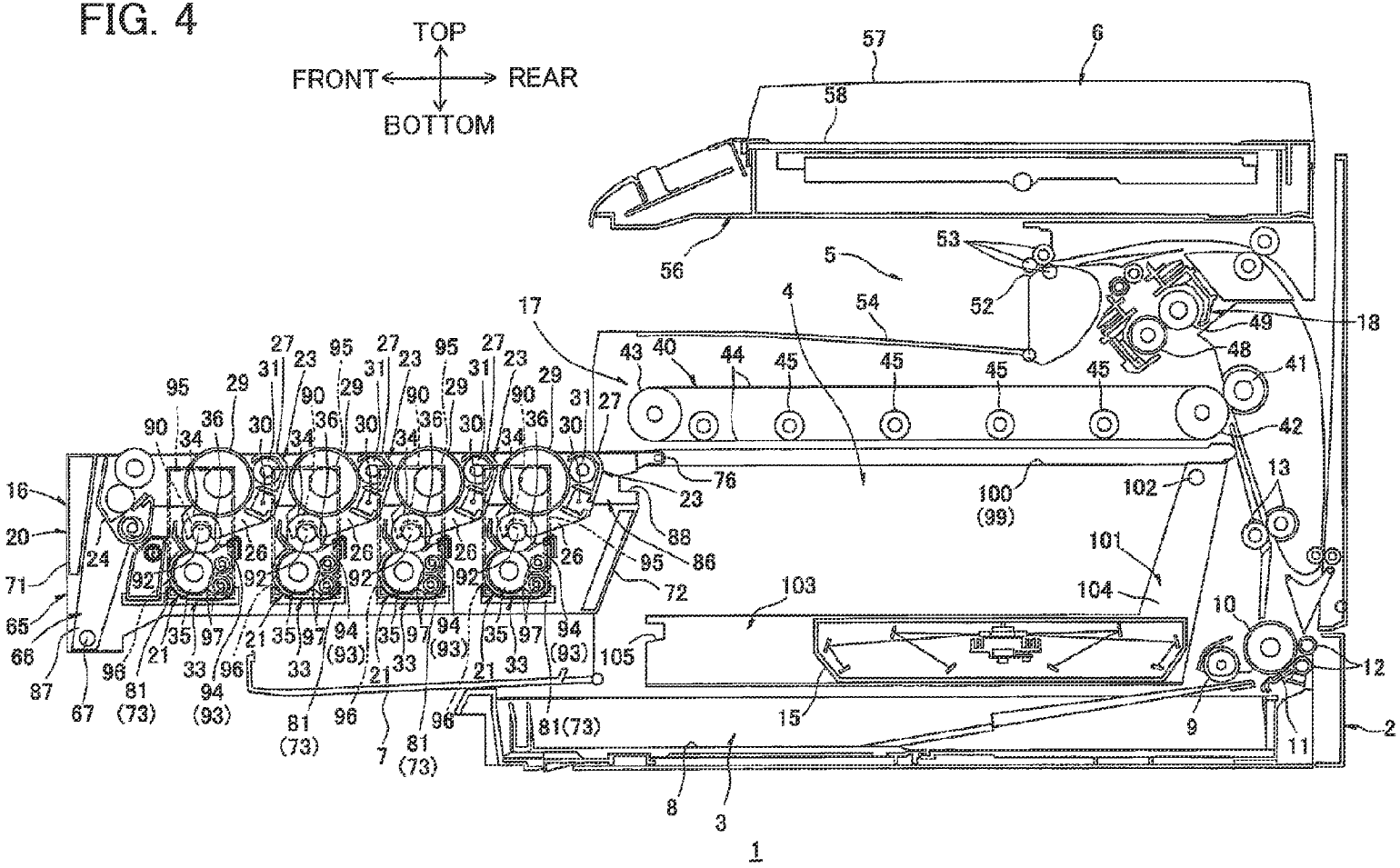
FIG. 4 is a central cross-sectional view of the printer according to the first embodiment when the process unit is in a withdrawn position, the process unit including a plurality of pivoting parts to receive corresponding developing cartridges.
Figure 5A:
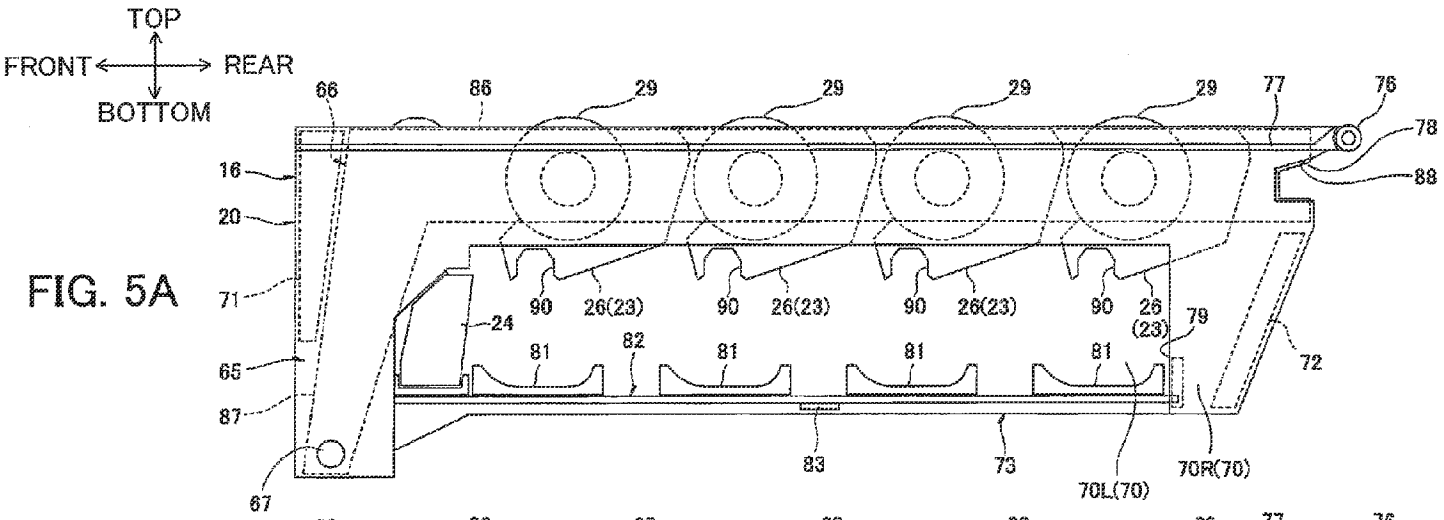
FIG. 5A is a right side view explaining detachment and attachment of the developing cartridges relative to the process unit, wherein the pivoting parts are in their first position.

The process frame 20 can slide along the front-rear direction between an internal position shown in FIG. 1 in which the process frame 20 is positioned inside the main casing 2, and an external position shown in FIG. 4 in which the process frame 20 is withdrawn to the outside of the main casing 2. As shown in FIGS. 5 and 6, the process frame 20 includes an outer frame 65, a pair of left and right process-side positioning plates 66, a process-side positioning shaft 67, and the drum frames 23 described above.

The outer frame 65 is formed of a hard resin material. The outer frame 65 has a frame-like structure with a general rectangular shape in a plan view. The outer frame 65 includes a pair of left and right side walls 70, a front wall 71, a rear wall 72, and a pivoting part 73.

The side walls 70 are disposed at positions spaced apart in the left-right direction. The side walls 70 have a generally flat plate shape that extends both vertically and in the front-rear direction. When it is necessary in the following description to distinguish the left and right side walls 70 from each other, the side wall 70 on the left will be referred to as the left side wall 70L, while the side wall 70 on the right will be referred to as the right side wall 70R.

Each side wall 70 is configured of a guide roller 76, a guide rail 77, and a notch 78.

The guide roller 76 has a general cylindrical shape and extends in the left-right direction. The guide roller 76 is rotatably disposed on the upper rear corner of the side wall 70.

The guide rail 77 is formed on the top edge of the side wall 70, from the front end of the side wall 70 to a point forward of the guide roller 76, and protrudes outward in the respective left-right direction to form a ridge-like shape.

The notch 78 is cut out in an upper rear portion of the side wall 70, forming a generally square U-shape in a side view that is recessed forward from the rear edge of the side wall 70 and is open on the rear side.

The right side wall 70R further includes a developing-cartridge extraction hole 79.

The developing-cartridge extraction hole 79 is cut out from the bottom edge of the right side wall 70R so as to have a generally square shape in a side view with an open bottom.

The front wall 71 bridges front ends of the side walls 70. The front wall 71 has a generally flat plate shape and is elongated both vertically and in the left-right direction.

The rear wall 72 bridges rear ends of the side walls 70. The rear wall 72 has a generally flat plate shape and is elongated both vertically and in the left-right direction.

The pivoting part 73 is provided on lower end portions of the side walls 70. The pivoting part 73 includes four developing-cartridge support parts 81, and a coupling rail 82.

The developing-cartridge support parts 81 are provided in a bottom portion of the outer frame 65 and are arranged at intervals in the front-rear direction to correspond to the positions of the developing cartridges 21. The developing-cartridge support parts 81 have a tray-like structure that extends in the left-right direction. The developing-cartridge support parts 81 have a left-right dimension greater than the distance between the side walls 70, i.e., the distance between the left side wall 70L and right side wall 70R (see FIG. 3). The developing-cartridge support parts 81 are allowed to pivot about their left ends on the lower portion of the left side wall 70L.

The coupling rail 82 is disposed along the bottoms of the developing-cartridge support parts 81 and has a general strip-like shape that spans across the entire front-rear dimension of the developing-cartridge extraction hole 79. The coupling rail 82 can move vertically along the edges of the right side wall 70R defining the front and rear edges of the developing-cartridge extraction hole 79. The coupling rail 82 includes a lever 83.

The lever 83 protrudes rightward from an approximate front-rear center region of the coupling rail 82.

With this construction, the developing-cartridge support parts 81 can be pivoted together by operating the lever 83 in order to move the coupling rail 82 vertically. In this way, the pivoting part 73 can move between a first position shown in FIG. 6A in which the developing-cartridge support parts 81 are supported in a substantially horizontal orientation, and a second position shown in FIG. 6B in which the developing-cartridge support parts 81 are supported at an angle sloping downward toward the right.

The process-side positioning plates 66 are configured to engage with casing-side positioning plates 101 described later in order to fix the positions of the photosensitive drums 29 relative to the main casing 2. The process-side positioning plates 66 are respectively positioned inside the corresponding side walls 70 so as to be separated from the corresponding side walls 70 in the left-right direction (see FIG. 3). The process-side positioning plates 66 are formed of a metal, such as stainless steel or steel. The process-side positioning plates 66 have a general L-shape in a side view (as indicated by broken lines in FIGS. 2, 5A and 5B). Specifically, each process-side positioning plate 66 is configured of a process-side body part 86, and a process-side extended part 87.

Each process-side body part 86 is positioned inward of the top edge of the corresponding side wall 70 with respect to the left-right direction. The process-side body part 86 has a flat plate shape that is generally rectangular in a side view and extends in the front-rear direction, spanning nearly the entire front-rear dimension of the side wall 70. The process-side body part 86 includes a process-side fitting groove 88.

The process-side fitting groove 88 is cut out in a rear end portion of the process-side body part 86 to form a general rectangular shape in a side view that is open on the rear side. The process-side fitting groove 88 is similar in shape to the notch 78 formed in the right side wall 70R but slightly smaller. When projected in the left-right direction, the process-side fitting groove 88 is positioned on the inside of the notch 78 formed in the right side wall 70R and is exposed through the notch 78.

The process-side extended part 87 is positioned inward of a front end portion of the corresponding side wall 70 with respect to the left-right direction. The process-side extended part 87 has a flat plate shape that is generally rectangular in a side view. The process-side extended part 87 extends continuously downward from a lower edge on the front end of the process-side body part 86, spanning nearly the entire vertical dimension of the side wall 70.

The process-side positioning shaft 67 is provided in a lower front corner of the process frame 20 and penetrates bottom end portions of the process-side extended parts 87 and lower front corners of the side walls 70 in the left-right direction. The process-side positioning shaft 67 is formed of metal, such as stainless steel or steel. The process-side positioning shaft 67 has a general rod shape and extends in the left-right direction. The left and right ends of the process-side positioning shaft 67 protrude outward in the corresponding left and right directions from outer left and right surfaces of the side walls 70.

The drum frames 23 are arranged between the pair of process-side body parts 86 in the left-right direction. The side walls 26 of the drum frames 23 have lower edge portions that are exposed through the developing-cartridge extraction hole 79 formed in the right side wall 70R in a right side view. Each side wall 26 is provided with a developing-roller-shaft fitting groove 90. The developing-roller-shaft fitting groove 90 is formed in the lower edge portion of the side wall 26 exposed through the developing-cartridge extraction hole 79. The developing-roller-shaft fitting grooves 90 are cut out from a lower edge of the side walls 26 and have a general square shape in a side view with an open bottom.

(2) Developing Cartridges

Figure 3:
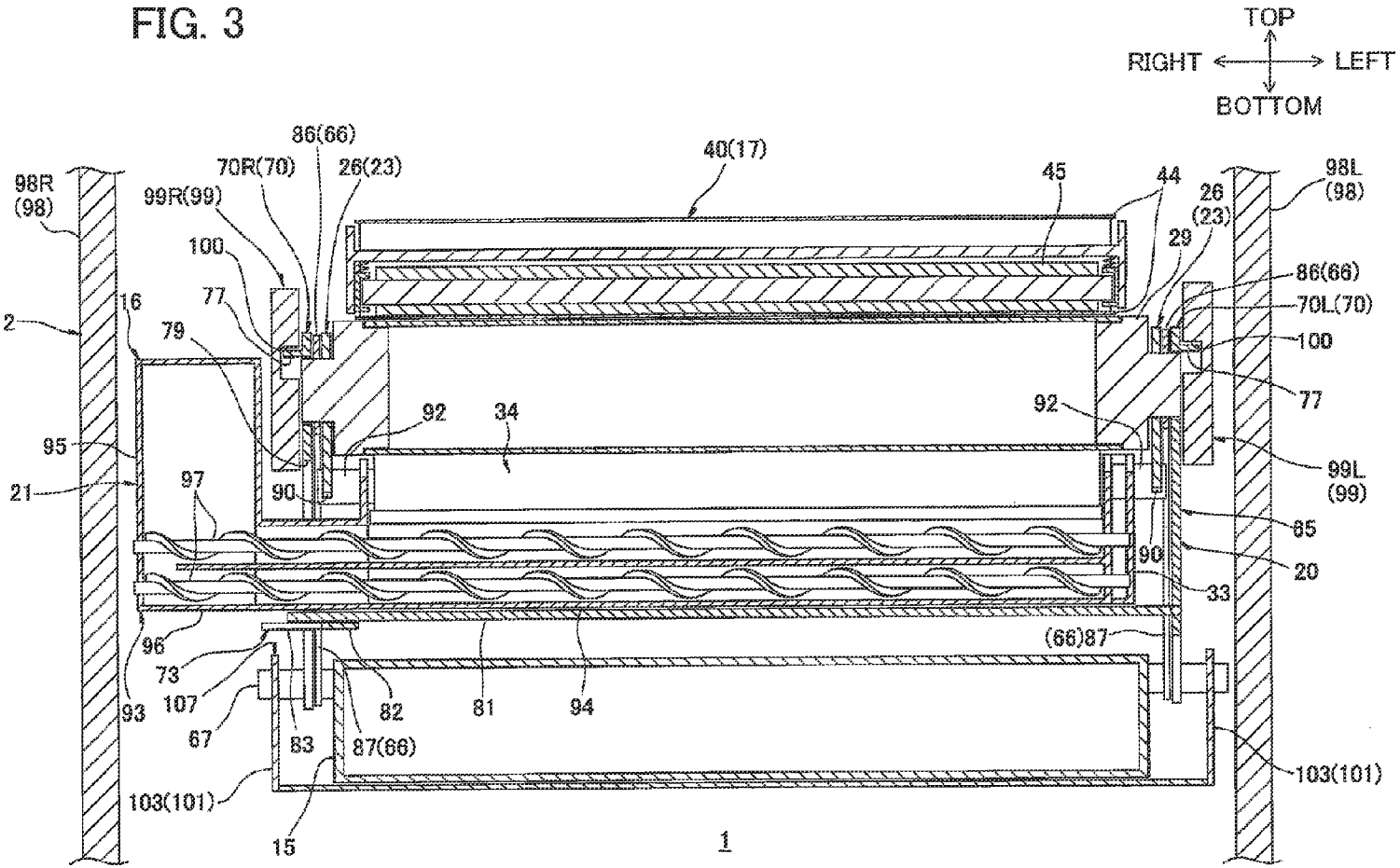
FIG. 3 is a cross-sectional view of the printer according to the first embodiment taken along a line A-A in FIG. 1.

As shown in FIG. 3, each developing cartridge 21 is disposed on a top surface of each developing-cartridge support parts 81 provided in the pivoting part 73. Each developing cartridge 21 is supported in the process frame 20 by fitting both ends of the developing-roller shaft 92 provided in the developing roller 34 into the corresponding developing-roller-shaft fitting grooves 90 formed in the side walls 26 from below.

The developing frame 33 of the developing cartridge 21 includes a toner-accommodating section 93 that serves to accommodate toner.

The toner-accommodating section 93 is provided with a first toner-accommodating section 94, a second toner-accommodating section 95, a third toner-accommodating section 96, and a pair of auger screws 97.

The first toner-accommodating section 94 occupies approximately the rear half of the developing frame 33. The first toner-accommodating section 94 has a generally square cylindrical shape and extends in the left-right direction. The first toner-accommodating section 94 is disposed inside the process frame 20, and specifically between the left side wall 70L and right side wall 70R. Hence, the first toner-accommodating section 94 has a left-right dimension that is shorter than the distance between the side walls 70, i.e., between the left side wall 70L and right side wall 70R. The interior of the first toner-accommodating section 94 is divided vertically by the border between the pair of auger screws 97.

The second toner-accommodating section 95 has a box-like shape and is elongated vertically. Hence, the second toner-accommodating section 95 has a vertical dimension greater than its left-right dimension. The second toner-accommodating section 95 is arranged such that its upper portion overlaps the photosensitive drum 29 in the left-right direction. When the process frame 20 is disposed in its internal position, the second toner-accommodating section 95 is disposed outside (rightward) of a right casing-side positioning plate 101 described later. More specifically, when the process frame 20 is disposed in its internal position, the second toner-accommodating section 95 is disposed between the right side wall 70R and a right casing side wall 98R described later.

The third toner-accommodating section 96 is formed continuously with a right end of the first toner-accommodating section 94 and extends rightward therefrom, and is connected to a bottom end of the second toner-accommodating section 95 and is integral therewith. That is, the third toner-accommodating section 96 has a left end that is in communication with the right end of the first toner-accommodating section 94, and an upper-right end portion that is in communication with the bottom end of the second toner-accommodating section 95. The third toner-accommodating section 96 is positioned to penetrate, in the left-right direction, an opening 107 that is defined by the right process-side body part 86, the right process-side extended part 87, a right casing-side body part 103, and a right casing-side extended part 104 when the process unit 20 is in the internal position, as will be described later. Put another way, the third toner-accommodating section 96 is aligned with the right end of the first toner-accommodating section 94 at the opening 107 in the left-right direction. As with the first toner-accommodating section 94, the interior of the third toner-accommodating section 96 is divided vertically by the border between the pair of auger screws 97.

The auger screws 97 are disposed in the first toner-accommodating section 94 and third toner-accommodating section 96 and extend in the left-right direction. The auger screws 97 are arranged parallel to each other and juxtaposed vertically. The left ends of the auger screws 97 are rotatably supported in the left wall of the first toner-accommodating section 94, and the right ends are rotatably supported in the right wall of the third toner-accommodating section 96. Note that the lower auger screw 97 conveys toner from the second toner-accommodating section 95 into the first toner-accommodating section 94 via the third toner-accommodating section 96, while the upper auger screw 97 conveys toner from the first toner-accommodating section 94 to the third toner-accommodating section 96, thereby circulating toner in left and right directions within the toner-accommodating section 93.

With this configuration, when the process frame 20 is disposed in its internal position, each photosensitive drum 29 is positioned below the intermediate transfer belt 44, and the corresponding first toner-accommodating section 94 is disposed below the photosensitive drum 29. In other words, the first toner-accommodating section 94 is positioned at a side opposite to the intermediate transfer belt 44 with respect to the photosensitive drum 29.

3. Detailed Description of the Main Casing

As shown in FIGS. 3 and 4, the main casing 2 is configured of a pair of casing side walls 98, and a pair of guide plates 99.

The casing side walls 98 are arranged parallel to each other and are separated in the left-right direction. The casing side walls 98 have a generally flat plate shape that extends in the front-rear and vertical directions. When it is necessary to distinguish the left and right casing side walls 98 in the following description, the casing side wall 98 on the left side will be called the left casing side wall 98L, while the casing side wall 98 on the right side will be called the right casing side wall 98R.

The guide plates 99 are positioned inside the respective casing side walls 98 in the left-right direction and are separated therefrom. The guide plates 99 have a generally flat plate shape and are elongated in the front-rear direction. When it is necessary to distinguish the left and right guide plates 99 in the following description, the guide plate 99 on the left side will be called the left guide plate 99L, while the guide plate 99 on the right side will be called the right guide plate 99R.

The left guide plate 99L is positioned between the left casing side wall 98L and the left side wall 70L of the process frame 20 when the process frame 20 is in its internal position.

The right guide plate 99R is positioned between the right casing side wall 98R and the right side wall 70R of the process frame 20 when the process frame 20 is in its internal position. The distance between the right guide plate 99R and right casing side wall 98R is greater than that between the left guide plate 99L and left casing side wall 98L. More specifically, the distance between the right guide plate 99R and right casing side wall 98R is greater than the left-right dimension of the second toner-accommodating section 95.

Each guide plate 99 includes a guide groove 100.

The guide groove 100 has a general linear shape that extends in the front-rear direction at a position lower than the belt unit 40. The guide groove 100 is recessed into an inner left-right surface of the guide plate 99. The guide grooves 100 slidably receive the guide rollers 76 and guide rails 77 of the process frame 20.

Figure 2:
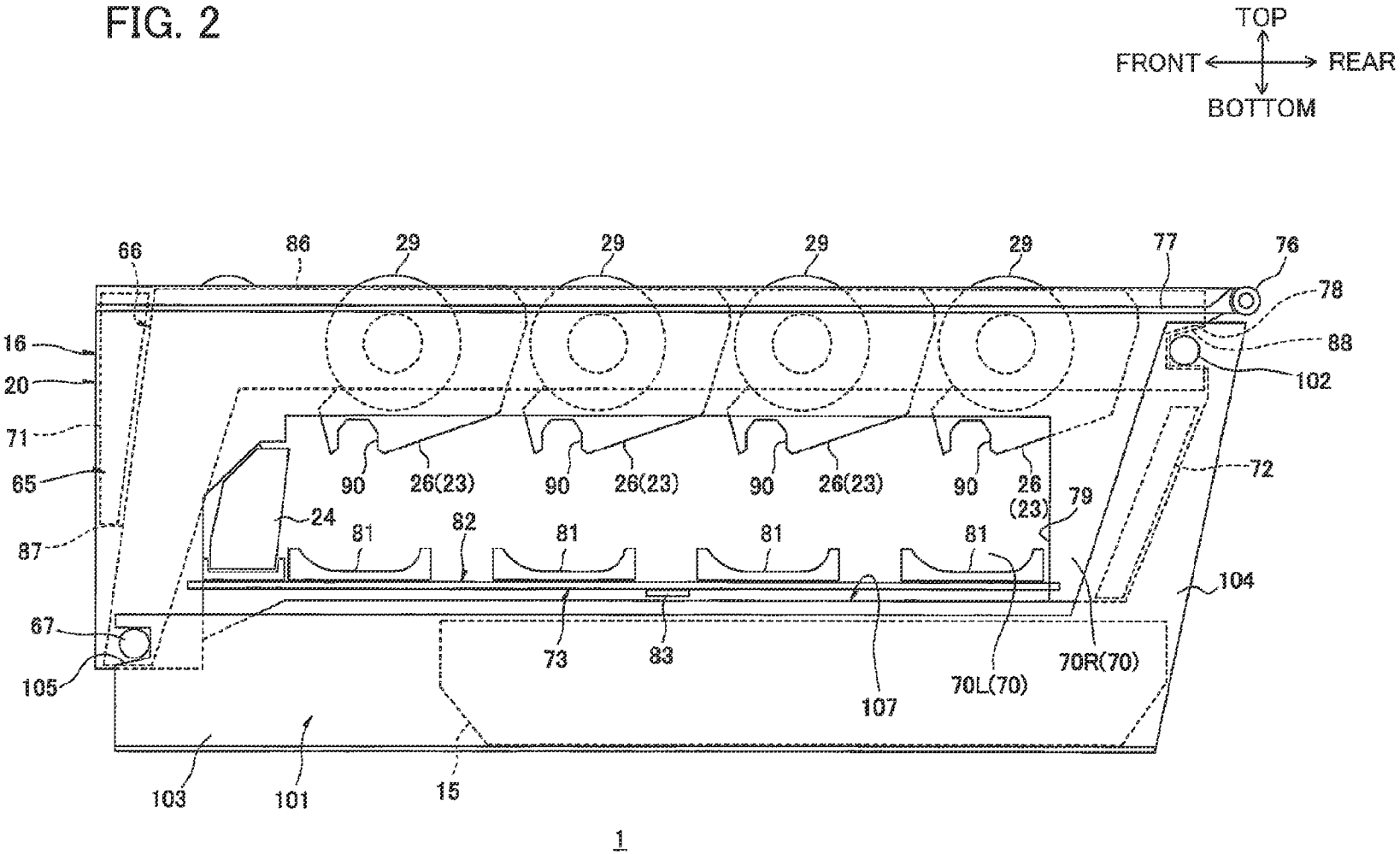
FIG. 2 is a right side view showing engagement of process-side positioning plates provided in the process unit and casing-side positioning plates provided in the printer, wherein parts other than essential portions are omitted in FIG. 2 for explanatory purpose.

As shown in FIGS. 2 and 3, the main casing 2 is also provided with a pair of left and right casing-side positioning plates 101, and a casing-side positioning shaft 102.

The casing-side positioning plates 101 function to position the photosensitive drums 29 within the main casing 2 when the process frame 20 is disposed in its internal position. The casing-side positioning plates 101 are respectively positioned within the main casing 2 outward of the scanning unit 15 in the left-right direction, respectively, and are positioned apart from the scanning unit 15. The casing-side positioning plates 101 are formed of a metal, such as stainless steel or steel. The casing-side positioning plates 101 have a general L-shape in a side view. Each casing-side positioning plate 101 includes a casing-side body part 103, and a casing-side extended part 104.

The casing-side body parts 103 are positioned outside of the respective left and right sides of the scanning unit 15 and are not in contact with the same. The casing-side body parts 103 have a flat plate shape that is generally rectangular in a side view and has approximately the same front-rear dimension as the process frame 20. Each casing-side body part 103 includes a casing-side fitting groove 105.

The casing-side fitting groove 105 is formed in a front edge portion of the corresponding casing-side body part 103 so as to recess rearward from its front edge. The casing-side fitting groove 105 has a general rectangular shape in a side view and is open on the front side. When the process frame 20 is disposed in the internal position, the left and right ends of the process-side positioning shaft 67 of the process frame 20 are fitted inside the corresponding casing-side fitting grooves 105.

The casing-side extended parts 104 have a flat plate shape and are generally rectangular in a side view. The casing-side extended parts 104 extend continuously upward from top edges of the corresponding casing-side body parts 103 at the rear ends of the same. The casing-side extended parts 104 have top ends that are positioned lower than the rear ends of the guide grooves 100 formed in the corresponding guide plates 99.

The casing-side positioning shaft 102 bridges the upper ends of the casing-side extended parts 104. The casing-side positioning shaft 102 is formed of a metal, such as stainless steel or steel. The casing-side positioning shaft 102 has a general rod shape and is oriented in the left-right direction. When the process frame 20 is in the internal position, the casing-side positioning shaft 102 is fitted inside the process-side fitting grooves 88 formed in the process-side positioning plates 66.

Thus, by engaging the casing-side positioning plates 101 with the corresponding process-side positioning plates 66, the casing-side body parts 103 and corresponding process-side body parts 86 are in positions separated vertically, and the casing-side extended parts 104 and corresponding process-side extended parts 87 are in positions separated in the front-rear direction. Thus, the opening 107 is defined, on each of the left and right sides, by the casing-side body parts 103, process-side body parts 86, casing-side extended parts 104, and process-side extended parts 87. Hereinafter, for explanatory purpose, the opening on the right defined by the right casing-side body part 103, right process-side body part 86, right casing-side extended part 104, and right process-side extended part 87 is referred to as the opening 107.

4. Mounting and Removing Developing Cartridges

The developing cartridges 21 are mounted in and removed from the main casing 2 by an operator. To remove a developing cartridge 21 from the main casing 2, first the operator opens the front cover 7 and pulls the process unit 16 (process frame 20) forward toward the position shown in FIG. 4. Through this operation, the process-side positioning shaft 67 is removed from the casing-side fitting grooves 105 formed in the casing-side positioning plates 101 and the casing-side positioning shaft 102 is removed from the process-side fitting grooves 88 formed in the process-side positioning plates 66. The operator pulls the process unit 16 (process frame 20) out to the external position as the guide rollers 76 and guide rails 77 on the process frame 20 are guided along the guide grooves 100 of the main casing 2.

Figure 5B:
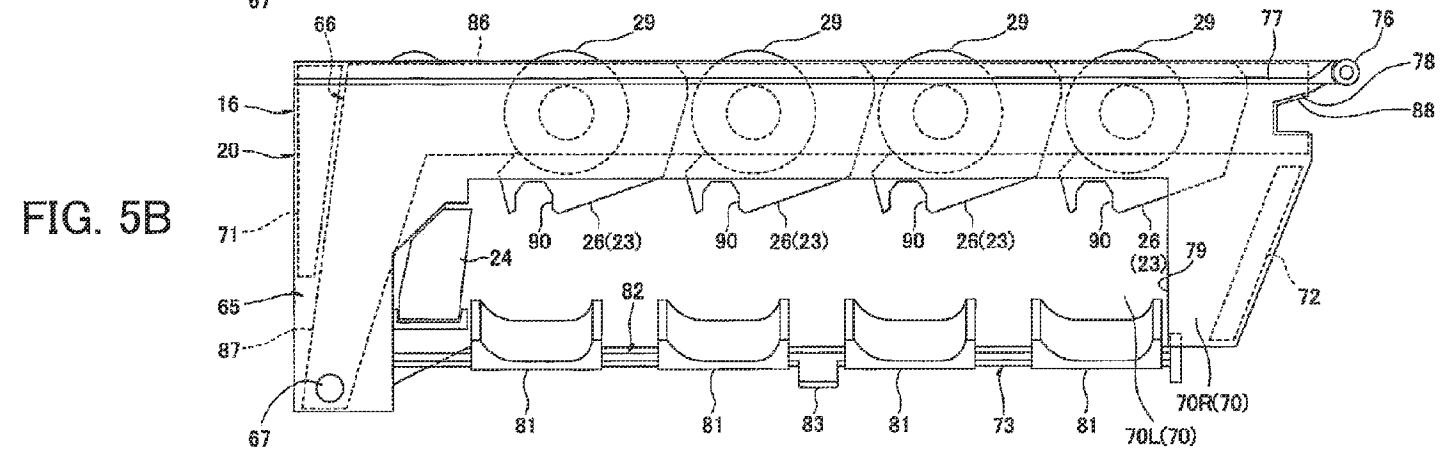
FIG. 5B is a right side view explaining detachment and attachment of the developing cartridges relative to the process unit, wherein the pivoting parts are in their second position.
Figure 6A:
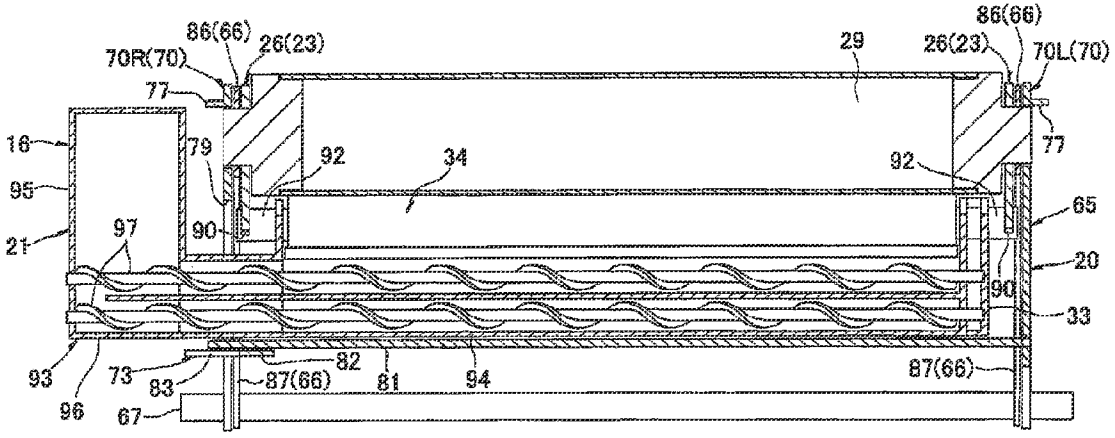
FIG. 6A is a cross-sectional rear side view explaining detachment and attachment of the developing cartridges relative to the process unit, wherein the pivoting parts are in their first position.
Figure 6B:
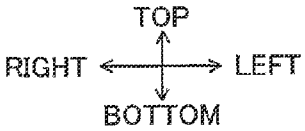
FIG. 6B is a cross-sectional rear side view explaining detachment and attachment of the developing cartridges relative to the process unit, wherein the pivoting parts are in their second position.
Figure 6B:
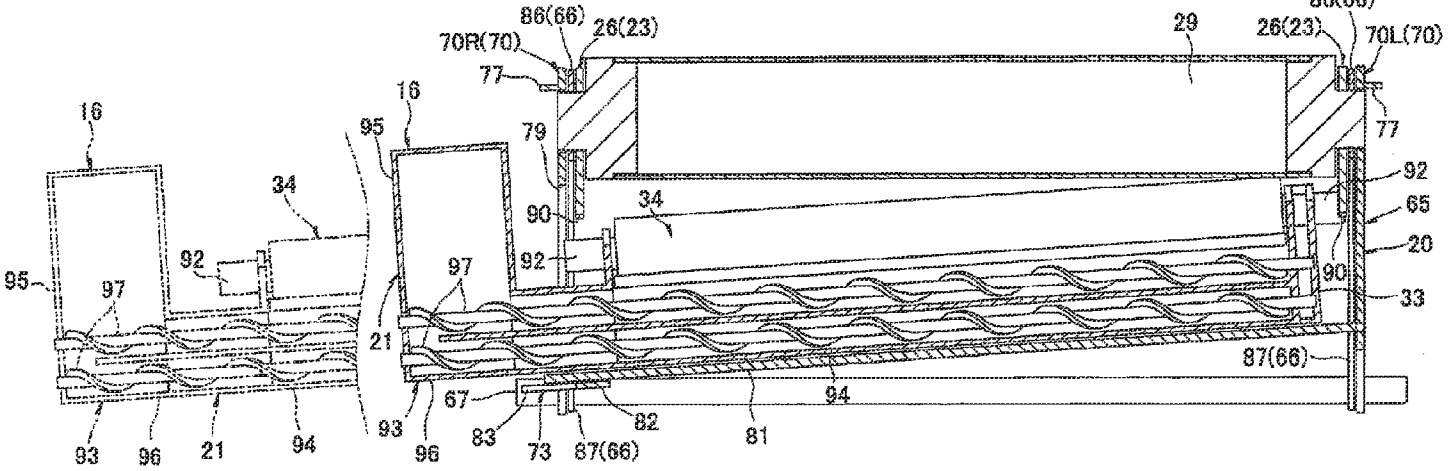

Next, the operator operates the lever 83 on the process frame 20 to move the pivoting part 73 from its first position (see FIGS. 5A and 6A) to its second position (see FIGS. 5B and 6B). Through this operation, the right ends of the developing-roller shafts 92 on all developing cartridges 21 are extracted (removed) from the right developing-roller-shaft fitting grooves 90.

At this time, the developing cartridges 21 are supported on the top surfaces of the corresponding developing-cartridge support parts 81 at an angle sloping downward toward the right. Accordingly, the operator can remove a developing cartridge 21 from the process frame 20 by pulling the developing cartridge 21 diagonally downward and rightward along the top surface of the developing-cartridge support parts 81, as illustrated by dashed lines in FIG. 6B.

This completes the operation for removing a developing cartridge 21 from the main casing 2. To mount a developing cartridge 21 in the main casing 2, the operation for removing a developing cartridge 21 described above is performed in reverse.

More specifically, the operator places the process unit 16 in the external position shown in FIG. 4 and places the pivoting part 73 in the second position shown in FIGS. 5B and 6B. Next, the operator places the left end of the developing cartridge 21 on the top surface of the corresponding developing-cartridge support parts 81 and pushes the developing cartridge 21 diagonally upward and leftward into the process unit 16 along the surface of the developing-cartridge support parts 81. As a result, the left end of the developing-roller shaft 92 becomes fitted into the left developing-roller-shaft fitting groove 90.

Next, the operator operates the lever 83 to move the pivoting part 73 from the second position back to the first position shown in FIGS. 5A and 6A. This operation fits the right end of the developing-roller shaft 92 into the right developing-roller-shaft fitting groove 90 so that the developing cartridge 21 is supported in the process frame 20.

Next, the operator pushes the process unit 16 into the main casing 2 from the state shown in FIG. 4. At this time, the process unit 16 slides rearward, with the guide rollers 76 and guide rails 77 of the process frame 20 guided in the guide grooves 100 formed in the main casing 2. As a result of this operation, the process-side positioning shaft 67 becomes fitted into the casing-side fitting grooves 105 of the casing-side positioning plates 101 and the casing-side positioning shaft 102 becomes fitted into the process-side fitting grooves 88 of the process-side positioning plates 66, placing the process unit 16 in its internal position shown in FIG. 1. Lastly, the operator closes the front cover 7, thereby completing the operation to mount a developing cartridge 21 in the main casing 2.

5. Operational Advantages (1) In the printer 1 according to the first embodiment, the toner-accommodating section 93 includes the first toner-accommodating section 94, second toner-accommodating section 95, and third toner-accommodating section 96. When the developing cartridge 21 is supported in the process frame 20, the first toner-accommodating section 94 is positioned between the left side wall 70L and right side wall 70R, the second toner-accommodating section 95 is positioned between the right side wall 70R and right casing side wall 98R, and the third toner-accommodating section 96 is configured to connect the first toner-accommodating section 94 and the second toner-accommodating section 95, as shown in FIG. 3.

Hence, with respect to the left-right direction, the first toner-accommodating section 94 of the toner-accommodating section 93 is positioned in the process frame 20 between the left side wall 70L and right side wall 70R, and the second toner-accommodating section 95 of the toner-accommodating section 93 is positioned between the right side wall 70R and right casing side wall 98R, i.e., between the main casing 2 and process frame 20. Hence, the second toner-accommodating section 95 can accommodate a sufficient amount of toner, while the developing cartridge 21 can be made more compact within the process frame 20. Thus, the overall printer 1 can be made smaller.

(2) With the printer 1 according to the first embodiment, the second toner-accommodating sections 95 having a greater vertical dimension than left-right dimension can be arranged in the space between the right casing side wall 98R and right side wall 70R, i.e., between the main casing 2 and process frame 20, as illustrated in FIG. 3. Hence, the toner capacity of the second toner-accommodating sections 95 can be increased, even though the space between the main casing 2 and process frame 20 is narrow. As a result, the toner capacity of the first toner-accommodating sections 94 positioned inside the process frame 20 can be reduced in order to reduce the size of the developing cartridges 21 positioned within the process frame 20.

(3) By pulling the process frame 20 out to the external position and placing the pivoting part 73 in the second position as illustrated in FIGS. 6A and 6B, the developing cartridge 21 can easily be pulled out of the process frame 20 along the top surface of the developing-cartridge support parts 81 in a direction diagonally downward and rightward. In other words, the developing cartridge 21 is pulled in a direction with the second toner-accommodating section 95 on the downstream end.

While conventionally developing cartridges 21 accommodated in the process frame 20 have been difficult to be extracted therefrom when the process frame 20 is in the external position shown in FIG. 4, the developing cartridges 21 are easy to be extracted in the printer 1 of the depicted embodiment because the second toner-accommodating sections 95 protrude from the right side of the process frame 20.

(4) Since the developing cartridges 21 can be made more compact within the process frame 20, as shown in FIG. 3, the configuration according to the first embodiment prevents the printer 1 from becoming larger when the photosensitive drums 29 are supported in the process frame 20.

(5) Since the developing cartridges 21 can be made more compact within the process frame 20, as shown in FIG. 3, the configuration according to the preferred embodiment prevents the printer 1 from becoming larger when the developing cartridges 21 are provided with the developing rollers 34.

(6) Since the intermediate transfer belt 44, photosensitive drum 29, and toner-accommodating section 93 are arranged vertically within the main casing 2, as shown in FIG. 3, there is a danger that the vertical dimension of the printer 1 will become larger. However, in addition to the first toner-accommodating section 94 disposed in the process frame 20, the toner-accommodating section 93 also includes the second toner-accommodating section 95 disposed in the space between the right side wall 70R and right casing side wall 98R, i.e., between the main casing 2 and process frame 20. Therefore, the first toner-accommodating section 94 can be made more compact while enabling the toner-accommodating section 93 to hold a sufficient quantity of toner due to the provision of the second toner-accommodating section 95. This configuration prevents the developing cartridge 21 from becoming too large in its vertical dimension achieving the low-profile printer 1.

(7) As shown in FIG. 3, the second toner-accommodating sections 95 are accommodated in the printer 1 in the space between the right side wall 70R positioned to the right of the photosensitive drums 29, and the right casing side wall 98R. By using the space in the printer 1 to the right of the photosensitive drums 29 to accommodate toner, the vertical dimension of the printer 1 can be made more compact.

(8) As shown in FIGS. 2 and 3, the casing-side positioning plates 101 can reliably position the photosensitive drums 29 supported in the process frame 20 relative to the main casing 2 while also supporting the second toner-accommodating sections 95 positioned further right of the right casing-side positioning plate 101. Hence, this configuration ensures that the photosensitive drums 29 are positioned accurately relative to the main casing 2, while allowing the vertical dimension of the printer 1 to be made more compact.

(9) By fitting the left and right ends of the process-side positioning shaft 67 into the casing-side fitting grooves 105 and fitting the casing-side positioning shaft 102 in the process-side fitting grooves 88 as shown in FIGS. 2 and 3, a vertical gap can be formed between the casing-side body parts 103 of the casing-side positioning plates 101 and the respective process-side body parts 86 of the process-side positioning plates 66 (on both left and right sides) when the casing-side positioning plates 101 are engaged with the process-side positioning plates 66. The third toner-accommodating section 96 is then disposed between the casing-side body part 103 and process-side body part 86 on the right side. Accordingly, by disposing the third toner-accommodating section 96 in this gap between the casing-side body part 103 and process-side body part 86, it is possible to provide the second toner-accommodating section 95 on the outside (right side) of the right casing-side positioning plate 101.

(10) As illustrated in FIG. 2, the casing-side positioning plates 101 and process-side positioning plates 66 can be reliably engaged to each other by engaging the process-side positioning shaft 67 penetrating the lower edges of the process-side extended part 87 with the casing-side fitting grooves 105 formed in the casing-side body parts 103 and by engaging the casing-side positioning shaft 102 bridging the upper ends of the casing-side extended parts 104 with the process-side fitting grooves 88 formed in the process-side body parts 86. This structure not only ensures sufficient rigidity of the printer 1, but also provides the printer 1 with the opening 107 defined by the casing-side positioning plate 101 and process-side positioning plates 66 on the right side. As a result, the photosensitive drums 29 can be accurately positioned relative to the main casing 2, and the toner-accommodating sections 93 can be extended (enlarged) rightward through the opening 107.

(11) As shown in FIG. 3, the third toner-accommodating section 96 of the toner-accommodating section 93 is inserted through the opening 107 formed by the casing-side body part 103, casing-side extended part 104, process-side body part 86, and process-side extended part 87 on the right side, enabling the second toner-accommodating section 95 to be provided rightward from the right end of the photosensitive drum 29. This construction ensures the rigidity of the printer 1 and enables the printer 1 to be made more compact in its vertical dimension. Moreover, by accommodating toner in the second toner-accommodating section 95, the printer 1 can be provided with a sufficient amount of toner.

6. Second Embodiment

A toner-accommodating section 93 according to a second embodiment will be described with reference to FIG. 7, wherein like parts and components are designated with the same reference numerals with those of the first embodiment to avoid duplicating description.

In the developing cartridge 21 according to the first embodiment described above, the toner-accommodating section 93 is integrally configured of the first toner-accommodating section 94, second toner-accommodating section 95, and third toner-accommodating section 96.

In contrast, the toner-accommodating section 93 of the second embodiment includes a first toner-accommodating section 110, a third toner-accommodating section 112 integrally configured with the first toner-accommodating section 110, and a second toner-accommodating section 111 detachably mounted on the third toner-accommodating section 112.

More specifically, the first toner-accommodating section 110 and third toner-accommodating section 112 are integrally configured so as to be in communication with each other internally. The third toner-accommodating section 112 is provided with a first communication opening 114, and the second toner-accommodating section 111 is provided with a second communication opening 115.

The first communication opening 114 is formed on a top wall of the third toner-accommodating section 112 and vertically penetrates the same so as to provide communication between the interior and exterior of the third toner-accommodating section 112.

The second communication opening 115 is formed on a bottom wall of the second toner-accommodating section 111 and vertically penetrates the same so as to provide communication between the interior and exterior of the second toner-accommodating section 111.

The second toner-accommodating section 111 is disposed above the third toner-accommodating section 112. The second toner-accommodating section 111 is engaged with the third toner-accommodating section 112 through engaging parts (not shown) so that the first communication opening 114 and second communication opening 115 are in communication with each other.

When the process frame 20 is disposed in the external position, the second toner-accommodating section 111 alone can be separated from the third toner-accommodating section 112 by disengaging the engaging parts. Hence, only the second toner-accommodating section 111 can be removed from the toner-accommodating section 93.

Figure 7:
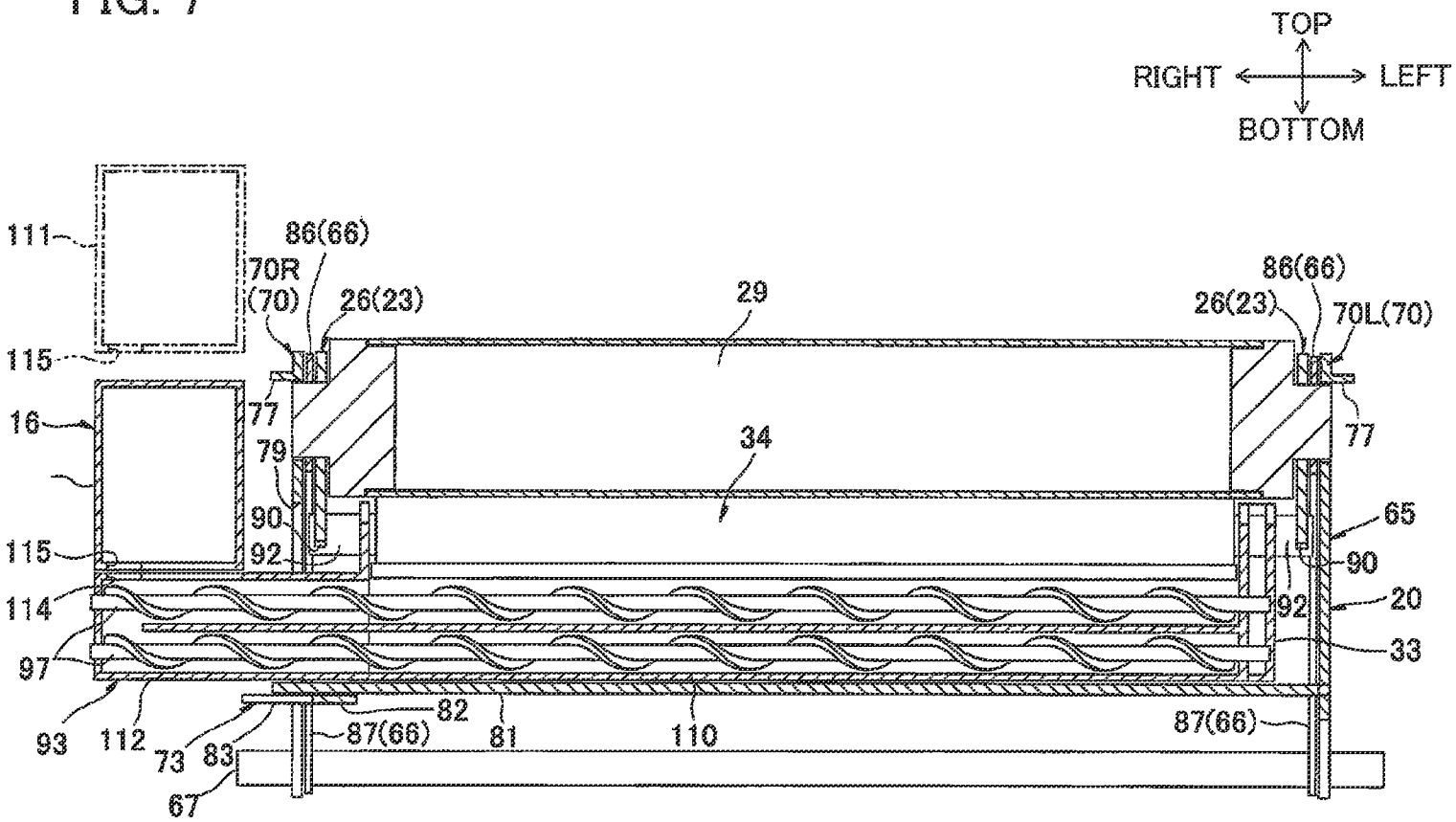
FIG. 7 is a vertical cross-sectional view of a process unit of an image forming apparatus according to a second embodiment of the present invention.

As illustrated by dashed lines in FIG. 7, the toner-accommodating section 93 according to the second embodiment can be replenished with toner through the simple operation of replacing only the second toner-accommodating section 111 on the third toner-accommodating section 112, rather than replacing the entire developing cartridge 21.

The printer according to the second embodiment can obtain the same operational and technical advantages described in the first embodiment.

7. Third Embodiment

While the printer 1 according to the first embodiment described above is configured as an intermediate transfer-type color printer, a printer 120 according to a third embodiment of the present invention is configured as a direct tandem-type color printer.

Next, the printer 120 of the third embodiment will be described with reference to FIGS. 8 through 10, wherein like parts and components are designated with the same reference numerals with those of the first embodiment to avoid duplicating description.

(1) Printer According to the Third Embodiment

Figure 8:
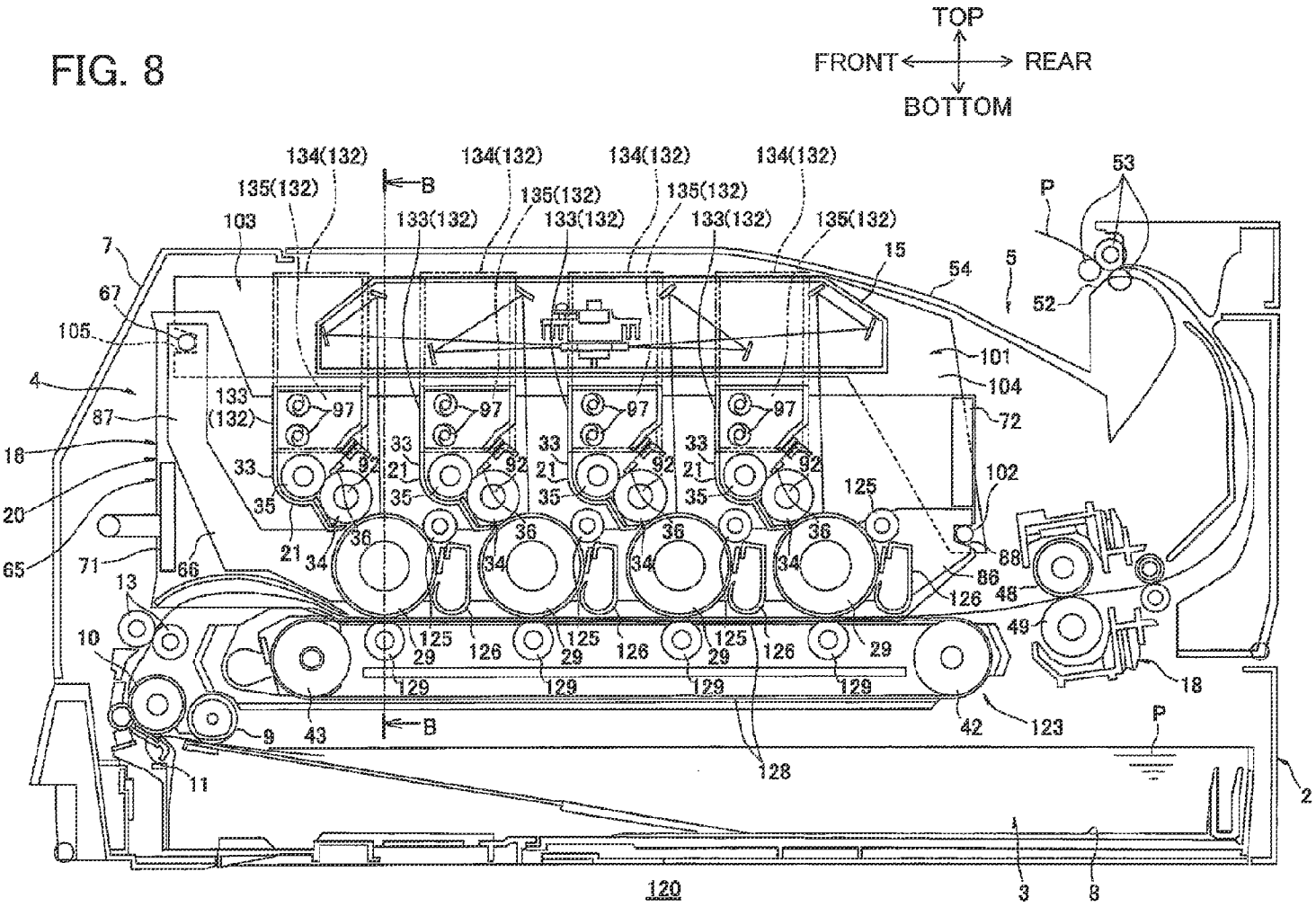
FIG. 8 is a central cross-sectional view of a printer as an example of an image forming apparatus according to a third embodiment of the present invention, wherein a process unit of the third embodiment is in the accommodated position.

The printer 120 shown in FIG. 8 is a horizontal direct tandem-type laser printer. The printer 120 includes the main casing 2 and, within the main casing 2, provided are the sheet-feeding unit 3 for feeding sheets of paper P, and the image-forming unit 4 for forming images on the sheets of paper P supplied by the sheet-feeding unit 3.

The sheet-feeding unit 3 conveys the sheets of paper P accommodated in the paper tray 8 between the photosensitive drums 29 and a conveying belt 128 described later at a prescribed timing.

The image-forming unit 4 is disposed above the sheet-feeding unit 3. The image-forming unit 4 includes the scanning unit 15, the process unit 16, and a transfer unit 123.

The scanning unit 15 is disposed in the top section of the main casing 2.

The process unit 16 is disposed beneath the scanning unit 15 in the approximate vertical center of the main casing 2. The process unit 16 of the third embodiment is provided with the process frame 20, and the plurality of developing cartridges 21.

The process frame 20 includes the plurality of photosensitive drums 29, a plurality of charging rollers 125, and a plurality of drum cleaning unit 126.

The photosensitive drums 29 are arranged at intervals in the front-rear direction.

The charging rollers 125 are disposed in positions for contacting the upper rear surfaces of the corresponding photosensitive drums 29.

The drum-cleaning units 126 are disposed in positions for contacting rear surfaces of the corresponding photosensitive drums 29.

The developing cartridges 21 of the third embodiment are disposed above the corresponding photosensitive drums 29. Each developing cartridge 21 includes the developing frame 33 and the developing roller 34.

The developing frame 33 has a box-like shape that is open on the lower rear side. The developing frame 33 is elongated in the left-right direction.

The developing roller 34 is disposed in the bottom end of the corresponding developing frame 33, with a portion of its peripheral surface exposed obliquely below and rearward of the developing frame 33. The developing roller 34 is rotatably supported in the developing frame 33 and is in contact with upper front surface of the corresponding photosensitive drum 29.

The transfer unit 123 is disposed in the main casing 2 at a position above the sheet-feeding unit 3 and below the process unit 16. The transfer unit 123 includes the drive roller 42, the follow roller 43, a conveying belt 128, and a plurality of transfer rollers 129.

The drive roller 42 is rotatably supported in the rear end of the transfer unit 123.

The follow roller 43 is rotatably supported in the front end of the transfer unit 123.

The conveying belt 128 is mounted on and looped around the drive roller 42 and follow roller 43 such that the upper portion of the loop opposes and contacts the bottom surfaces of all photosensitive drums 29. When the drive roller 42 is driven to rotate, the conveying belt 128 circulates so that its upper portion moves rearward, and the follow roller 43 follows the circulation of the conveying belt 128.

The transfer rollers 129 are arranged parallel to each other and are spaced at intervals in the front-rear direction. Specifically, the transfer rollers 129 are disposed inside the loop of the conveying belt 128 between the drive roller 42 and follow roller 43 at positions beneath the corresponding photosensitive drums 29. The transfer rollers 129 contact the upper portion of the conveying belt 128 from below.

When the sheet-feeding unit 3 feeds a sheet of paper P onto the conveying belt 128, the conveying belt 128 conveys the sheet rearward so that the sheet P passes sequentially between the photosensitive drums 29 and corresponding transfer rollers 129. As the sheet P is conveyed on the conveying belt 128, toner images carried on the surfaces of the photosensitive drums 29 are sequentially transferred onto the sheet P to form a color image thereon.

(2) Process Unit According to the Third Embodiment (2-1) Process Frame

Figure 9:
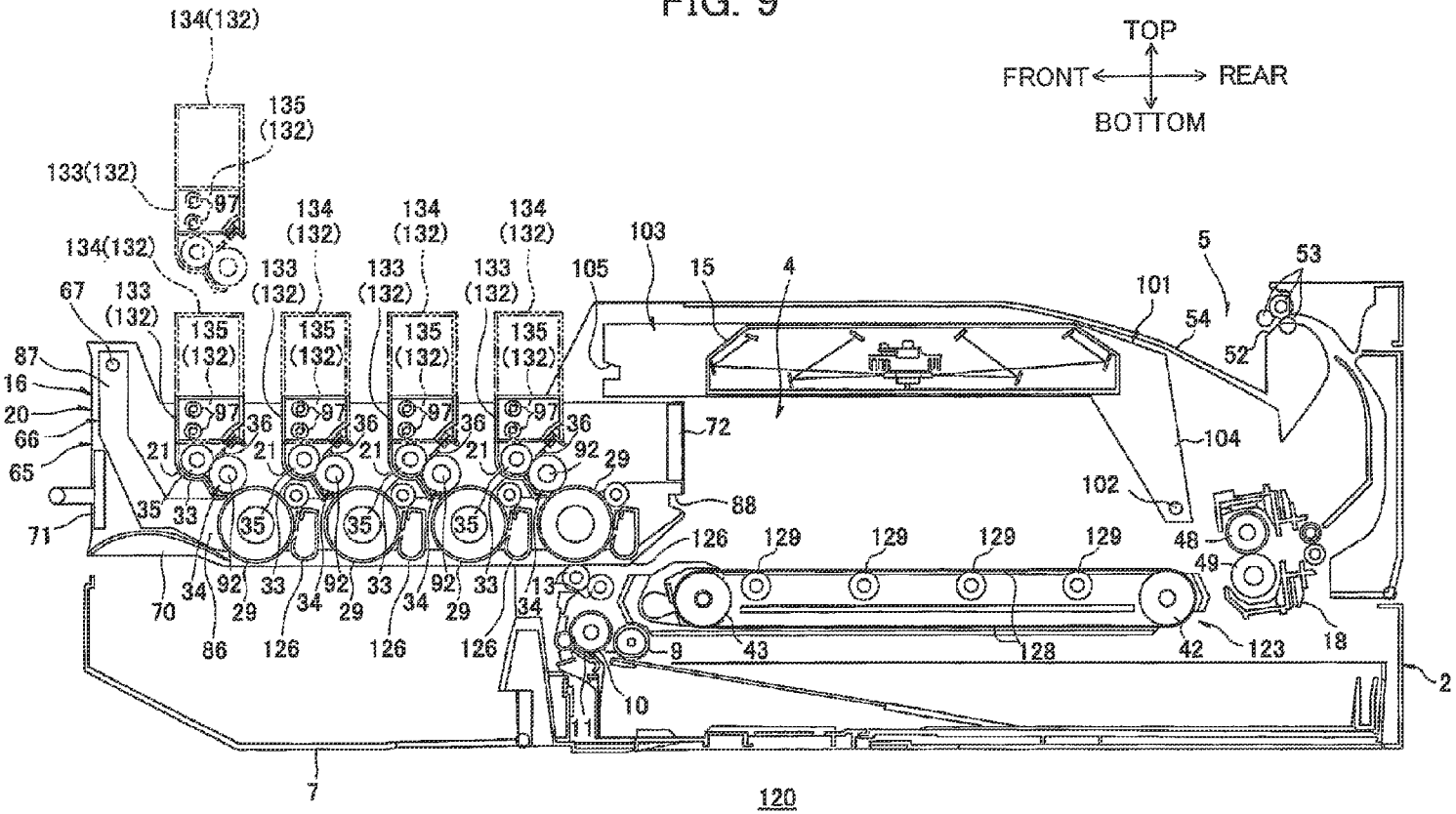
FIG. 9 is a central cross-sectional view of the printer according to the third embodiment when the process unit of the third embodiment is in the withdrawn position.

The process frame 20 can slide with respect to the front-rear direction between an internal position shown in FIG. 8 in which the process frame 320 is disposed inside the main casing 2, and an external position shown in FIG. 9 in which the process frame 20 is withdrawn to the outside of the main casing 2.

The process frame 20 includes the pair of process-side positioning plates 66, and the process-side positioning shaft 67.

Each process-side positioning plate 66 includes the process-side body part 86 and the process-side extended part 87.

The process-side body parts 86 are disposed inward of the corresponding side wall 70 constituting the outer frame 65 with respect to the left-right direction, and specifically inward of the lower portions of the side walls 70.

The process-side extended parts 87 extend continuously upward from the top edges on the front end portions of the corresponding process-side body parts 86.

The process-side positioning shaft 67 is provided in the upper front corner of the process frame 20 and penetrates top ends of the process-side extended parts 87 and upper front corners of the side walls 70 in the left-right direction.

(2-2) Developing Cartridges

Figure 10:
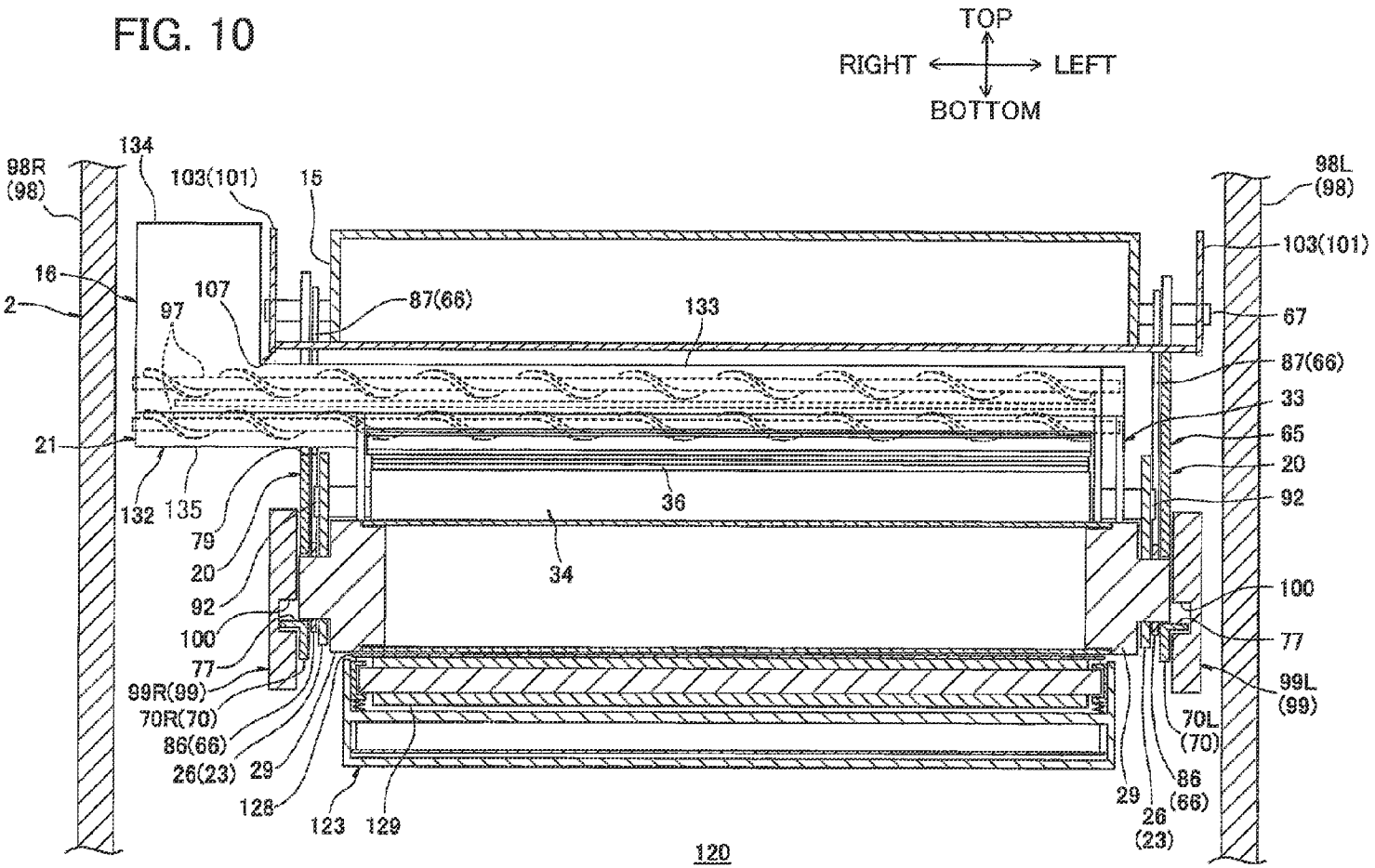
FIG. 10 is a cross-sectional view of the printer according to the third embodiment taken along a line B-B shown in FIG. 8.

As shown in FIG. 10, each developing cartridge 21 includes a toner-accommodating section 132.

The toner-accommodating section 132 is provided with a first toner-accommodating section 133, a second toner-accommodating section 134, and a third toner-accommodating section 135.

The first toner-accommodating section 133 occupies approximately the upper half of the developing frame 33. The first toner-accommodating section 133 has a generally square cylindrical shape and extends in the left-right direction. The first toner-accommodating section 133 is disposed inside the process frame 20, and specifically between the left side wall 70L and right side wall 70R. Hence, the first toner-accommodating section 133 has a left-right dimension shorter than the distance between the side walls 70, i.e., between the left side wall 70L and right side wall 70R.

The second toner-accommodating section 134 has a box-like shape and is elongated vertically. Hence, the second toner-accommodating section 134 has a vertical dimension greater than its left-right dimension. The second toner-accommodating section 134 is arranged such that its upper portion overlaps the scanning unit 15 in the left-right direction when the process frame 20 is disposed in the internal position. Also, when the process frame 20 is disposed in its internal position, the second toner-accommodating section 134 is disposed outside (rightward) of the right casing-side positioning plate 101. More specifically, when the process frame 20 is disposed in its internal position, the second toner-accommodating section 134 is disposed between the right side wall 70R and the right casing side wall 98R.

The third toner-accommodating section 135 is formed continuously with a right end of the first toner-accommodating section 133 and extends rightward therefrom, and is connected to a bottom end of the second toner-accommodating section 134. That is, the left end of the third toner-accommodating section 135 is in communication with the right end of the first toner-accommodating section 133, and the top portion on the right end of the third toner-accommodating section 135 is in communication with the bottom end of the second toner-accommodating section 134. The third toner-accommodating section 135 is positioned to penetrate in the left-right direction the opening 107 that is surrounded by the process-side body part 86, process-side extended part 87, casing-side body part 103, and casing-side extended part 104 disposed on the right side. In other words, the third toner-accommodating section 135 is connected to the right end of the first toner-accommodating section 133 at the opening 107 in the left-right direction.

With this configuration, when the process frame 20 is disposed in its internal position, each photosensitive drum 29 is positioned above the conveying belt 128, and the corresponding first toner-accommodating section 133 is disposed above the photosensitive drum 29. In other words, the first toner-accommodating section 133 is positioned at a side opposite to the conveying belt 128 with respect to the photosensitive drum 29.

(3) Main Casing According to the Third Embodiment

The main casing 2 is provided with the pair of casing-side positioning plates 101, and the casing-side positioning shaft 102.

Each casing-side positioning plate 101 includes the casing-side body part 103, and the casing-side extended part 104.

The casing-side body parts 103 are positioned outside of the respective left and right sides of the scanning unit 15 disposed in the top section of the main casing 2 and are not in contact with the scanning unit 15.

The casing-side extended parts 104 extend continuously downward from the bottom edges of the corresponding casing-side body parts 103 at the rear ends of the same.

The casing-side positioning shaft 102 bridges the lower ends of the casing-side extended parts 104.

(4) Mounting and Removing Developing Cartridges According to the Third Embodiment The developing cartridges 21 are mounted in and removed from the main casing 2 by an operator. To remove a developing cartridge 21 from the main casing 2, first the operator opens the front cover 7 and pulls the process unit 16 forward toward the position shown in FIG. 9. Through this operation, the process-side positioning shaft 67 is removed from the casing-side fitting grooves 105 formed in the casing-side positioning plates 101 and the casing-side positioning shaft 102 is removed from the process-side fitting grooves 88 formed in the process-side positioning plates 66. The operator pulls the process unit 16 out to the external position as the guide rollers 76 and guide rails 77 on the process frame 320 are guided along the guide grooves 100 of the main casing 2.

Next, the operator lifts the developing cartridge 21 upward relative to the process frame 20 so that the developing cartridge 21 is removed from the process frame 20, as indicated by dashed lines in FIG. 9.

This completes the operation for removing a developing cartridge 21 from the main casing 2. To mount a developing cartridge 21 in the main casing 2, the operation for removing a developing cartridge 21 described above is performed in reverse.

More specifically, the operator places the developing cartridge 21 above the process frame 20 while the process unit 16 is in the external position shown in FIG. 9 and pushes the developing cartridge 21 downward into the process frame 20. Next, the operator pushes the process unit 16 into the main casing 2 from the state shown in FIG. 9. At this time, the process unit 16 slides rearward, with the guide rollers 76 and guide rails 77 of the process frame 20 guided in the guide grooves 100 formed in the main casing 2. As a result of this operation, the process-side positioning shaft 67 becomes fitted into the casing-side fitting grooves 105 of the casing-side positioning plates 101 and the casing-side positioning shaft 102 becomes fitted into the process-side fitting grooves 88 of the process-side positioning plates 66, placing the process unit 16 in its internal position shown in FIG. 8. Lastly, the operator closes the front cover 7, thereby completing the operation to mount a developing cartridge 21 in the main casing 2.

(5) Operational and Technical Advantages of the Third Embodiment

In the printer 120 according to the third embodiment shown in FIG. 10, the second toner-accommodating sections 134 of the toner-accommodating sections 132 can be accommodated in the space between the right side wall 70R and right casing side wall 98R to the right of the scanning unit 15 in the printer 120. Accordingly, the vertical dimension of the printer 120 can be made smaller by using the space in the printer 120 to the right of the scanning unit 15 disposed in the upper section of the main casing 2 to accommodate toner.

The printer 120 according to the third embodiment can obtain the same operational and technical advantages described in the first embodiment.

While the invention has been described in detail with reference to the specific embodiment thereof, it would be apparent to those skilled in the art that various changes and modifications may be made therein without departing from the spirit of the invention.

What is claimed is:

1. An image forming apparatus comprising:

a main casing comprising a first wall and a second wall extending in a first direction and opposing each other in a second direction orthogonal to the first direction;

a supporting frame configured to move relative to the main casing in the first direction between an internal position accommodated in the main casing and an external position withdrawn from the main casing, the supporting frame comprising a first plate and a second plate extending in the first direction and configured to oppose the first wall and the second wall in the second direction respectively when the supporting frame is at the internal position; and a developer container configured to be supported in the supporting frame and configured to store developer therein, the developer container comprising:

a first chamber configured to be disposed between the first plate and the second plate;

a second chamber configured to store developer therein and be disposed between the first wall and the first plate when the supporting frame is at the internal position;

a third chamber configured to establish communication between the first chamber and the second chamber; and a conveying portion configured to convey the developer stored in the second chamber to the first chamber via the third chamber.

2. The image forming apparatus as claimed in claim 1, wherein the second chamber defines a length in the second direction and a length in a third direction orthogonal to the first direction and the second direction, the length in the third direction being larger than the length in the second direction.

3. The image forming apparatus as claimed in claim 2, wherein the developer container is configured to be supported in the supporting frame such that the developer container is detachable from and attachable to the supporting frame in the second direction.

4. The image forming apparatus as claimed in claim 2, wherein the second chamber is configured to be detached from and attached to the third chamber.

5. The image forming apparatus as claimed in claim 1, further comprising an image carrier configured to carry an electrostatic latent image thereon, the image carrier being supported on the supporting frame.

6. The image forming apparatus as claimed in claim 5, wherein the developer container further comprises a developer carrier configured to carry developer thereon to supply the developer to the electrostatic latent image on the image carrier.

7. The image forming apparatus as claimed in claim 5, further comprising an endless belt configured to oppose the image carrier when the supporting frame is at the internal position, the first chamber being positioned opposite to the endless belt with respect to the image carrier when the supporting frame is at the internal position.

8. The image forming apparatus as claimed in claim 5, wherein the second chamber has a portion positioned to overlap with the image carrier in the second direction when the supporting frame is at the internal position.

9. The image forming apparatus as claimed in claim 5, further comprising an exposing unit configured to expose the image carrier to light and positioned offset from the image carrier in a third direction orthogonal to the first direction and the second direction, wherein the second chamber has a portion disposed to overlap with the exposing unit in the second direction when the supporting frame is at the internal position.

10. The image forming apparatus as claimed in claim 5, wherein the main casing further comprises a main-casing positioning plate disposed inward of the first wall in the second direction and configured to provide positioning of the image carrier relative to the main casing, and wherein the second chamber is positioned outward of the main-casing positioning plate in the second direction when the supporting frame is at the internal position.

11. The image forming apparatus as claimed in claim 10, wherein, the supporting frame further comprises:

a supporting-frame positioning plate configured to engage the main-casing positioning plate and provide positioning of the image carrier relative to the main casing in cooperation with the main-casing positioning plate;

wherein the main-casing positioning plate has a main-casing first portion extending in the first direction;

wherein the supporting-frame positioning plate has a supporting-frame first portion extending in the first direction and configured to oppose the main-casing first portion in a third direction orthogonal to the first direction and the second direction when the supporting-frame positioning plate engages the main-casing positioning plate; and wherein the third chamber is positioned between the main-casing first portion and the supporting-frame first portion in the third direction when the supporting frame is at the internal position.

12. The image forming apparatus as claimed in claim 11, wherein the main-casing first portion has one end and another end opposite to each other in the first direction;

wherein the supporting-frame first portion has one end and another end opposite to each other in the first direction, the one end and the another end of the main-casing first portion opposing the one end and the another end of the supporting-frame first portion in the third direction, respectively, when the supporting frame is at the internal position;

wherein the main-casing positioning plate further includes a main-casing second portion extending from the one end of the main-casing first portion toward the one end of the supporting-frame first portion and configured to engage the one end of the supporting-frame first portion when the supporting frame is at the internal position;

wherein the supporting-frame positioning plate further includes a supporting-frame second portion extending from the another end of the supporting-frame first portion toward the another end of the main-casing first portion and configured to engage the another end of the main-casing first portion when the supporting frame is at the internal position.

13. The image forming apparatus as claimed in claim 12, wherein, when the supporting frame is at the internal position, the main-casing first portion, the main-casing second portion, the supporting-frame first portion and the supporting-frame second portion define an opening extending in the first direction and the third direction, the third chamber being configured to penetrate the opening in the second direction.

* * * * *